US005414501A

United States Patent [19]

Miura et al.

[11] Patent Number: 5,414,501

[45] Date of Patent: May 9, 1995

[54] IMAGE FORMING APPARATUS FOR FORMING IMAGES ON BOTH SURFACES OF RECORDING MATERIAL

[75] Inventors: Yasushi Miura, Kawasaki; Nobuhiko Takekoshi, Tokyo, both of Japan

[73] Assignee: Canon Kabushiki Kaisha, Tokyo, Japan

[21] Appl. No.: 266,450

[22] Filed: Jun. 28, 1994

Related U.S. Application Data

[63] Continuation of Ser. No. 112,987, Aug. 30, 1993, abandoned.

[30] Foreign Application Priority Data

Aug. 28, 1992 [JP] Japan ..... 4-254077

[51] Int. Cl.[6] ..... G03G 15/16; G03G 15/01

[52] U.S. Cl. ..... 355/271; 355/326 R; 355/327

[58] Field of Search ..... 355/326, 327, 271, 319, 355/272, 274; 346/157

[56] References Cited

U.S. PATENT DOCUMENTS 4,712,906 12/1987 Bothner et al. .
5,006,900 4/1991 Baughman et al. ..... 355/271
5,049,934 9/1991 Saito ..... 355/327 X
5,084,737 1/1992 Hagen ..... 355/274
5,128,717 7/1992 Uchikawa et al. ..... 355/271 X
5,155,535 10/1992 Bermel ..... 355/326 X

*Primary Examiner*—R. L. Moses
*Attorney, Agent, or Firm*—Fitzpatrick, Cella, Harper & Scinto

[57] ABSTRACT

An image forming apparatus including an image bearing member for bearing a toner image; a transfer material carrying member for carrying a transfer material, the transfer material being a dielectric sheet; a transferring member for transferring the toner image from the image bearing member onto the transfer material carried on the transfer material carrying member, the transferring member being contactable to a back side of the transfer material carrying member; current controller for keeping constant current supplied to the transferring member; wherein after the toner image is transferred onto a first surface of the transfer material, a toner image can be transferred onto the second surface of the same transfer material; and wherein when the toner image is transferred onto the second surface, the current controller supplies the transferring member with a predetermined current.

29 Claims, 4 Drawing Sheets

IMAGE FORMING APPARATUS FOR FORMING IMAGES ON BOTH SURFACES OF RECORDING MATERIAL

This application is a continuation of application Ser. No. 08/112,987, filed Aug. 30, 1993, now abandoned.

FIELD OF THE INVENTION AND RELATED ART

The present invention relates to an image forming apparatus such as a copying machine or laser beam printer, in particular, to an image forming machine capable of forming multicolor images on both surfaces of a recording material.

It is known that in a full-color image forming machine, toner images formed on a photosensitive member, that is, an image bearing member, are transferred by a transfer corona charger, onto the transfer material carried on a transfer material carrying member of the transfer drum. After each of the toner images of yellow, magenta, cyan, and black colors are transferred onto the transfer material in a superimposing manner, the transfer material is conveyed to a fixing apparatus. In the fixing apparatus, four toner images of different colors are fused, mixed, and fixed onto the transfer material.

With recent progresses in color imaging the, desire to form color images on both surfaces of the transfer material has been growing stronger.

However, when a multicolor image is formed on both surfaces of the transfer material, there are differences in the water contents of the transfer material, amount of the transferred toner, amount of oil adhering to the transfer material due to the fixing operation, or the like, between when the toner image is transferred onto one (first surface) of the surfaces of the transfer material and when the toner images are transferred onto the other (second) surface, which causes the transfer material to display different resistance values between the first and second surfaces.

Therefore, when a prior image forming apparatus is used to form the multicolor image on both surfaces of the transfer material, a transfer operation sometimes fails, thereby producing a image degraded by scattered toner, missing spots, or the like. In order to prevent this problem, the transfer charger comprising a corona charger or the like must be controlled in such a manner that transfer conditions such as a transfer electric field is changed to accommodate the fluctuating resistance value of the transfer material. This creates a problem since it is complicated to control the transfer conditions.

Further, during the double sided image formation, after the image is transferred and fixed onto the first surface of the transfer material, the image bearing member, transfer drum, and the like, must be cleaned and cleared of charge, in other words, they must be prepared for the image formation before the image forming operation for the second surface begins. Therefore, when the multicolor image is continuously formed on both surfaces of two or more transfer materials, there is a problem in that it takes a relatively long time.

SUMMARY OF THE INVENTION

The primary object of the present invention is to provide an image forming apparatus capable of properly transferring the toner image onto the transfer material, regardless of the fluctuation of the resistance value of the transfer material which is caused by the difference in the amount of the oil adhering to the transfer material, or the like.

According to an aspect of the present invention, it is easy to control the transfer condition in which the toner image is transferred onto the second surface of the transfer material.

According to another aspect of the present invention, excellent images can be formed on both surfaces of the transfer material.

According to a further aspect of the present invention, the speed at which the toner images are transferred on both surface of the transfer material is increased.

According to another aspect of the present invention, excellent images can be formed without changing the transfer condition between the first and the second surfaces.

These and other objects, features and advantages of the present invention will become more apparent upon a consideration of the following description of the preferred embodiments of the present invention, taken in conjunction with the accompanying drawings.

DETAILED DESCRIPTION OF THE PREFERRED EMBODIMENTS

Figure 1:
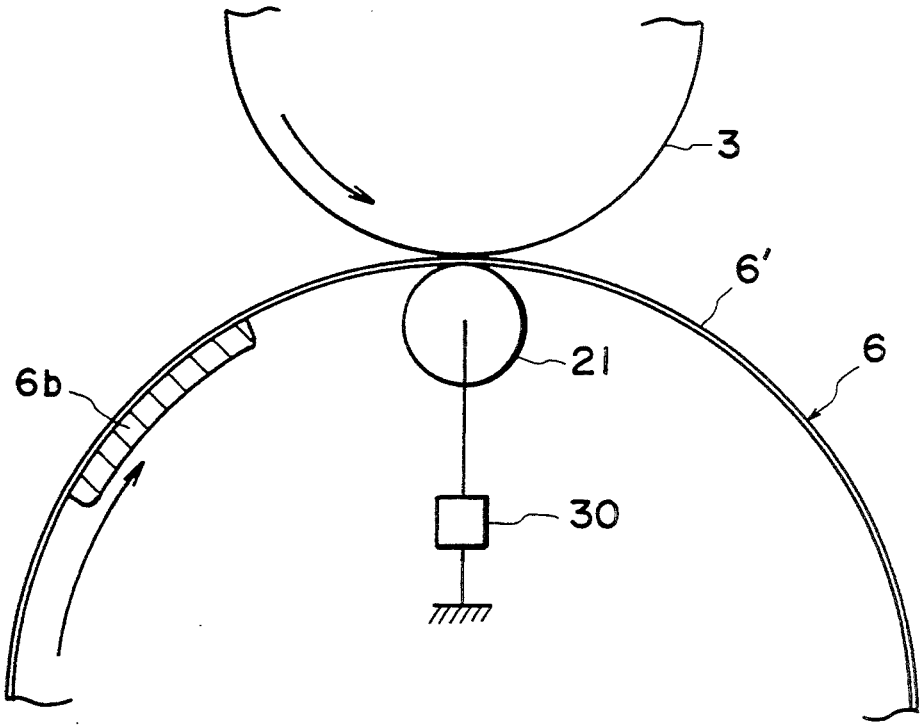
FIG. 1 is a sectional view of the transfer charger and transfer drum in a preferred embodiment of an image forming apparatus in accordance with the present invention.

Hereinafter, the embodiments of the present invention will be described, referring to the drawings.

Figure 4:
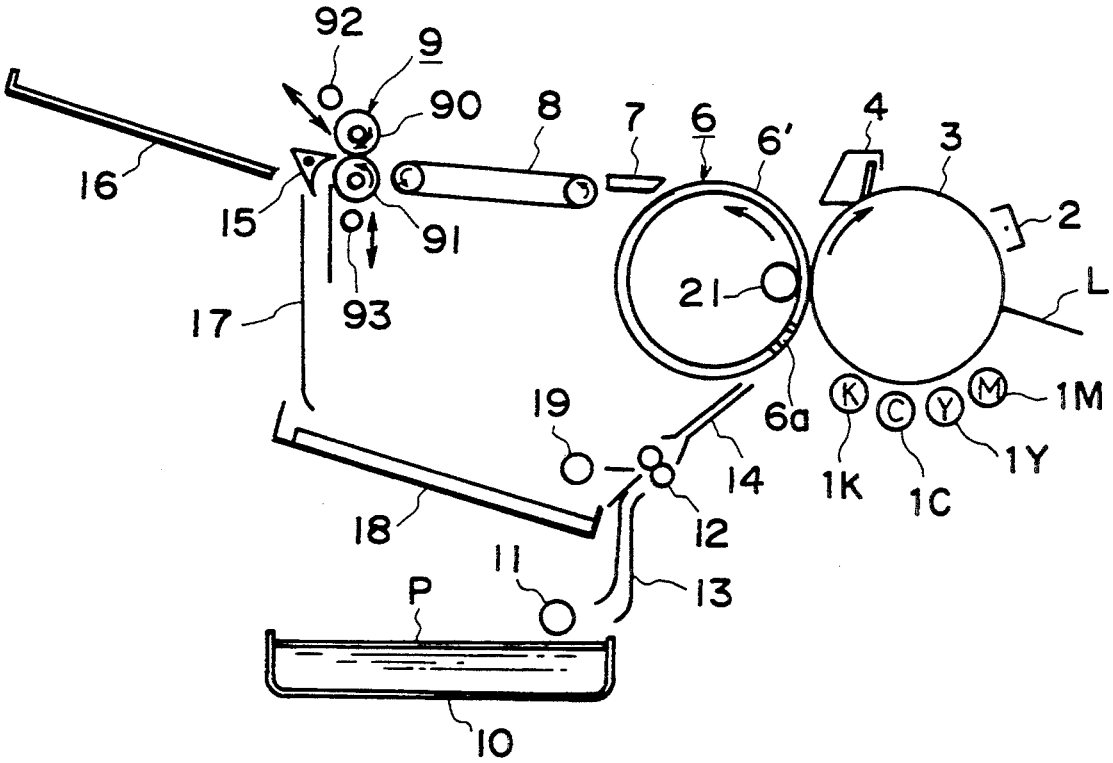
FIG. 4 is a schematic sectional view of the preferred embodiment of an image forming apparatus in accordance with the present invention, showing the essential structure.

FIG. 4 shows the mechanical configuration of an image forming apparatus capable of forming multicolor images on both surfaces of a transfer material P, showing the essential components. In this drawing, a reference numeral 3 designates a photosensitive drum, that is, an image bearing member, which rotates in the predetermined direction. Disposed around the photosensitive drum are a primary charger 2, a magenta developer 1M, a yellow developer 1Y, a cyan developer 1C, a black developer 1K, and a cleaning apparatus 4.

Figure 5:
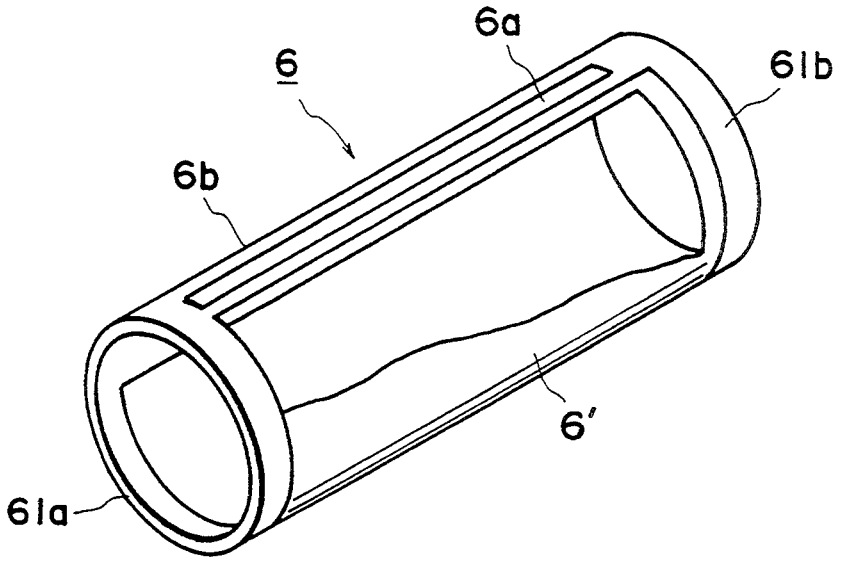
FIG. 5 is a perspective view of a transfer drum.

The transfer drum 6 is disposed in contact with the photosensitive drum 3, and rotates while holding the transfer material P by a grip 6*a*, therefore, carrying the transfer material P around itself. Within the transfer charger 6, a transferring member 21 is provided for applying a transfer electric field to the transfer material P so that the toner image borne on the photosensitive drum 3 is transferred onto the transfer material P. Referring to FIG. 5, the transfer drum 6 comprises a frame made by connecting a pair of rings 61*a* and 61*b* with connecting member 6*b*, and a dielectric sheet 6' composed of dielectric material, wherein the dielectric sheet 6' is extended, as a carrier of the transfer material, around the aforementioned frame in such a manner as to enclose the empty space of the frame, thereby serving as the peripheral surface of the drum. The transfer material P is carried on the dielectric sheet 6'. The grip 6*a* is disposed on the connecting member 6*b*.

On the down stream side, with reference to the transfer drum 6, of the transfer material conveyance passage, there are a separating claw, a conveying member 8, and a fixing apparatus 9, being arranged in this order. A sheet feeding cassette 10, a feed roller 11, a registration roller 12, a first guide 13, and a second guide 14 are disposed on the sheet feeding side of the transfer drum 6. On the sheet discharging side of the fixing apparatus 9, there is a recycling guide 15 for directing the transfer material P either toward a discharge tray 16 or toward a re-conveyance passage comprising a third guide 17, an intermediate tray 18, a feed roller 19, and the like.

The fixing apparatus 9 comprises: a fixing roller 90 which has a built-in heater serving as the heat source, and rotates in a predetermined direction; a pressure roller 91 which rotates while pressing itself onto the fixing roller 90; first and second rollers 92 and 93. The first and second rollers 92 and 93 are movable in the directions indicated by arrows in the drawing, being capable of coming into contact with the rollers 91 and 92 to coat them with a parting agent such as oil.

To begin with, an operation is described in which a full-color image is formed by this image forming apparatus only on one surface (first surface) of the transfer material P. First, the photosensitive drum 3 is uniformly charged by the primary charger 2, and then, is exposed to a scanning beam L emitted from a laser scanner, carrying the data of magenta, whereby an electrostatic latent image is formed on the photosensitive drum 8, corresponding to the magenta data. This electrostatic latent image is developed by the magenta developer 1M containing magenta toner, in other words, it is visualized as a toner image of magenta color. This toner image is transferred onto the transfer material P wrapped (carried) around the dielectric sheet 6' of the transfer drum 6, by the transfer electric field generated by the transferring member 21.

After the completion of the transfer, the photosensitive drum 3 is cleaned by the cleaning apparatus 4, and is again uniformly charged by the primary charger 2. Then, it is exposed to the scanning beam emitted from the scanner unit, carrying this time, however, the yellow data, whereby an electrostatic latent image corresponding to the yellow data is formed. This electrostatic latent image is developed by the yellow developer 1Y containing yellow toner, in other words, it is visualized as a yellow toner image. The yellow toner image is transferred by the transferring member 21 onto the transfer material P carried around the dielectric sheet 6', in such a manner as to be superimposed on the aforementioned magenta image.

Next, an electrostatic latent images corresponding to the data for cyan color and an electrostatic latent image corresponding to the data for black color are formed one after another, in the same manner as the preceding ones, on the photosensitive drum 3, and are developed by the cyan developer 1C and the black developer 1K, respectively. The obtained cyan toner image and black toner image are transferred onto the first surface of the transfer material P, so that the four toner images of different color are superimposed to create a color image.

The transfer material P is fed from the sheet feeding cassette 10. The transfer material P fed by the feed roller 11, one by one, out of the sheet feeding cassette 10 is sent to the registration roller 12 through the first guide 13. The registration roller 12 sends out the transfer material P in synchronization with the timing with which the toner image is formed on the photosensitive drum 3, and then, it is conveyed to the transfer drum 6 through the second sheet guide 14. As soon as the transfer material P arrives at the transfer drum 6, it is gripped by the gripper 6*a* of the transfer drum 6, and is positioned on the transfer drum in a manner to be wrapped around the transfer drum 6 as the transfer drum 6 rotates, whereby it is passed through an image transfer station formed where the transfer drum 9 and the photosensitive drum 3 come in contact with each other. While the transfer material P is passing through the transfer station, the tone image on the photosensitive drum 3 is transferred onto the transfer material P.

After four toner images of different color are transferred onto the transfer material P, the transfer material P is peeled off the transfer drum 6 by the separating claw 7, and is conveyed by the conveying member 8 to the fixing apparatus 9, where it is to be fixed. In the fixing apparatus 9, the transfer material P is pinched between the fixing roller 90 and the pressure roller 91, and is passed through a nip formed by two rollers 90 and 91. While the transfer material P is passed through the nip, the toner images are heated and pressed, whereby they are fused, with their color being mixed, to the transfer material P, creating thereby a permanent full-color image on the transfer material P. Meanwhile, the first coating roller 92 comes in contact with the fixing roller 90, and coats the fixing roller 90 with the fixing oil as the parting agent. After the toner images are fixed on the transfer material P, the transfer material P is accumulated on the discharge tray 16 through the recycling guide 15.

Now then, when a transfer material having a resistance value of approximately $10^6$ ohm.cm is passed once between the fixing roller being controlled to hold 180° C., and the pressure roller, under a condition in which the humidity is 60% RH, its resistance value is increased to $10^7$ to $10^8$ Ω/cm. This is because the water contents of the transfer material 9 is reduced by being subjected to the high temperature. Further, it has been known that when the toner containing resin particles, or silicone oil of dimethyl group, or the like is used as the parting agent, the resistance value of the transfer material P becomes higher after the fixing operation. In order to generate an electric field capable of transferring satisfactorily the toner images onto the second surface of the transfer material P which at this time has a higher resistance value than when the images are transferred on the first surface, so that a color image as good as the one created on the first surface can be obtained, the impedance increase must always be taken into consideration.

FIG. 1 is an enlarged sectional view of the transfer station in the image forming apparatus shown in FIG. 4, and its adjacent area.

In this embodiment, an electrically conductive roller 21 is disposed as the transferring member within the transfer drum 6, as shown in FIG. 1. This conductive roller 21 contacts the back side of the dielectric sheet 6', at a location where the photosensitive drum 3 and the transfer drum 6 meet, and is connected to a bias power source 30 which applies a voltage to the conductive roller 21, whereby the conductive roller 21 generates the transfer electric field when a voltage is applied to the conductive roller 21 from the power source 30. Incidentally, in FIG. 1, the reference numeral 6b designates a pair of connecting members which connect an unshown pair of rings of the transfer drum 6.

If the volume resistivity value of the conductive roller 21 exceeds $10^8$ ohm.ch, a faulty transfer occurs. Therefore, it is preferred to be no higher than $10^8$ ohm.ch, more preferably, $10^2$ to $10^7$ ohm.cm. The conductive roller 21 employed in this embodiment is 20 mm in diameter and has a volume resistivity value of $10^5$ ohm.cm. This conductive roller 21 is disposed in contact with the dielectric sheet 6', on the back surface, with a contact pressure (transfer pressure) of 10 g/cm$^2$.

The conductive roller 21 is disposed within the boundary of the transfer station, between where the transfer material rolled up around the dielectric sheet 6' begins to contact the photosensitive drum 3 and where they are separated. Since the conductive roller 21 has elasticity, and is disposed extremely close to the back side of the dielectric sheet 6', it contacts the back surface of the dielectric sheet 6'in a manner to push the dielectric sheet 6' outward. This conductive roller 21 may be rotated by the transfer drum 6, so that it moves at the same speed as the dielectric sheet 6', or may be directly rotated at a different peripheral speed.

In this embodiment, the conductive roller 21 described above is employed as the transferring member, and the transfer electric field is generated by applying a voltage from the power source 30 to this conductive roller 21, whereby the toner images of different color from the photosensitive drum 3 are transferred first onto one (first) of the surfaces of the transfer material carried on the dielectric sheet 6' of the transfer drum 6, and next, onto the other (second) surface of the transfer material which is turned over and again held on the dielectric sheet 6' of the transfer drum 6 after the toner image is transferred onto the first surface, wherein a constant current control is executed in such a manner that the same predetermined amount of transfer current is supplied from the power source 30 during the transfer operations for the first and second surfaces.

This embodiment is different from a transfer charger comprising the corona charger, in that the transfer current is allowed to flow from the conductive roller 21, through the dielectric sheet 6', to the transfer material, through direct contacts. Therefore, even if the transfer material's resistance value changes between the transfer operations for the first and second surfaces, the same amount of transfer current can be flowed by executing the constant current control. Therefore, a proper amount of transfer current is reliably obtained, substantially in response to the amount of toner charge, whereby the same control value can be used for transferring the toner images either on the first surface or the second surface.

In this embodiment of image forming apparatus shown in FIG. 4, the transfer material conveyance speed is 180 mm/sec. The dielectric sheet 6' is made of polyfluorovinylidene resin film, wherein the thickness is 150 μm and the volume resistivity value is approximately $10^{14}$ ohm.cm. As for the toner, two component resin toner of approximately 25 μC/b. As for the transfer material, plain paper having a resistance value of $10^6$ ohm.cm is used.

Hereinafter, the transferring process is described referring to a case in which a black toner image (solid image) large enough to cover the substantial surface of the transfer material is transferred on both surfaces of the transfer material, wherein a constant current control is executed for both the first and second surfaces.

The appropriate transfer current for the first surface was 20 μA, and the corresponding output voltage was approximately 2 KV. After the toner image was transferred onto the first surface, the resistance value of the transfer material increased because the fixing oil adhering to the transfer material and/or the transfer material dried while passing through the fixing apparatus. Therefore, when the constant current control was executed to maintain the current flow of 20 μA for transferring the toner image onto the second surface, the corresponding output voltage increased to 3 KV, and the toner image was properly transferred.

Next, the transferring process is by referring to another case in which the voltage applied from the power source to the transfer charger was kept constant at 2 KV while the solid black toner image was transferred onto of the first and second surfaces.

When the toner image was transferred onto the first surface of the transfer material having the same resistance of $10^6$ ohm.cm as the transfer material used in the preceding test, the transfer current flowing through the transfer charger was 20 μA, properly transferring the toner image.

However, when the toner image was transferred onto the second surface, the transfer current was 13 μA because the resistance of the transfer material was higher at this time than when the toner image was transferred onto the first surface. In other words, the transfer current was reduced as the resistance of the transfer material increased. Therefore, the solid black toner image was unevenly transferred, and the transfer efficiency dropped.

In the above described tests, the solid black image was transferred onto both surfaces of the transfer material, but the same results were also obtained when the text image (highlight image) was transferred. In other words, when the transfer charger was placed under the constant current control, the toner image transfer properly occurred on both surfaces of the transfer material, but when the transfer charger was placed under the constant voltage control, the text image transferred onto the second surface was inferior because of the scattered toner.

In the above described tests, the toner image transferred had a single color of black when the transfer charger was placed under the constant current or voltage control. However, the aforementioned transfer characteristics more conspicuously manifest themselves when the toner images of different color are sequentially transferred in a color image forming apparatus such as the color image forming apparatus shown in FIG. 4. Therefore, when the toner image is transferred on both surfaces of the transfer material, it is preferable that the transfer charger is placed under the constant current control.

Further, since the resistance value of the transfer material changes in response to the ambient temperature or humidity, it is preferable that the transfer charger is placed under the constant current control even when the toner image is transferred onto the first surface.

Figure 6:
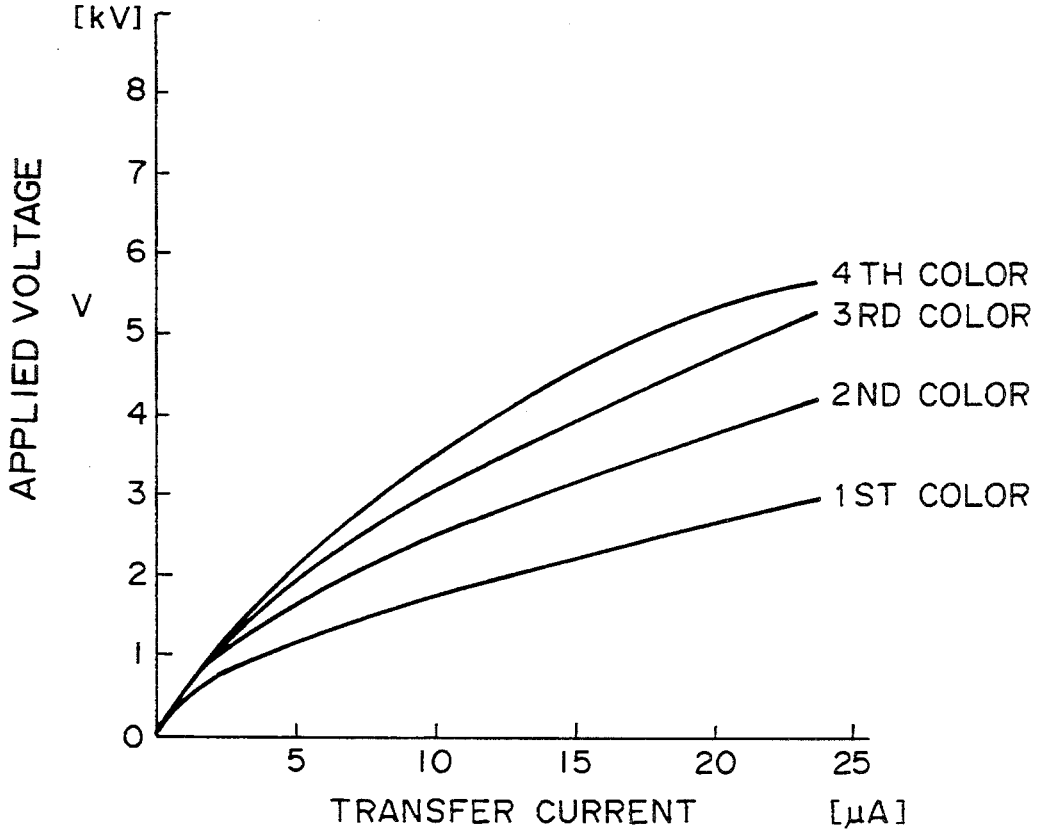
FIG. 6 is a graph showing the relation between the transfer current output and the voltage output of a transfer power source.

A graph in FIG. 6 shows the relation between the voltage output value and the target transfer current value when the transfer charger of the image forming apparatus described in connection with this embodiment was placed under the constant current control, wherein the target transfer current value was varied. As is evident from the graph, the voltage output value gradually increased as the transfer count for a single transfer material increased. For example, when the target transfer current value was 20 μA, the voltage output value for the fourth color was twice that for the first color. Therefore, the effects of the present invention become more evident when applied to the color image forming apparatus.

Figure 2:
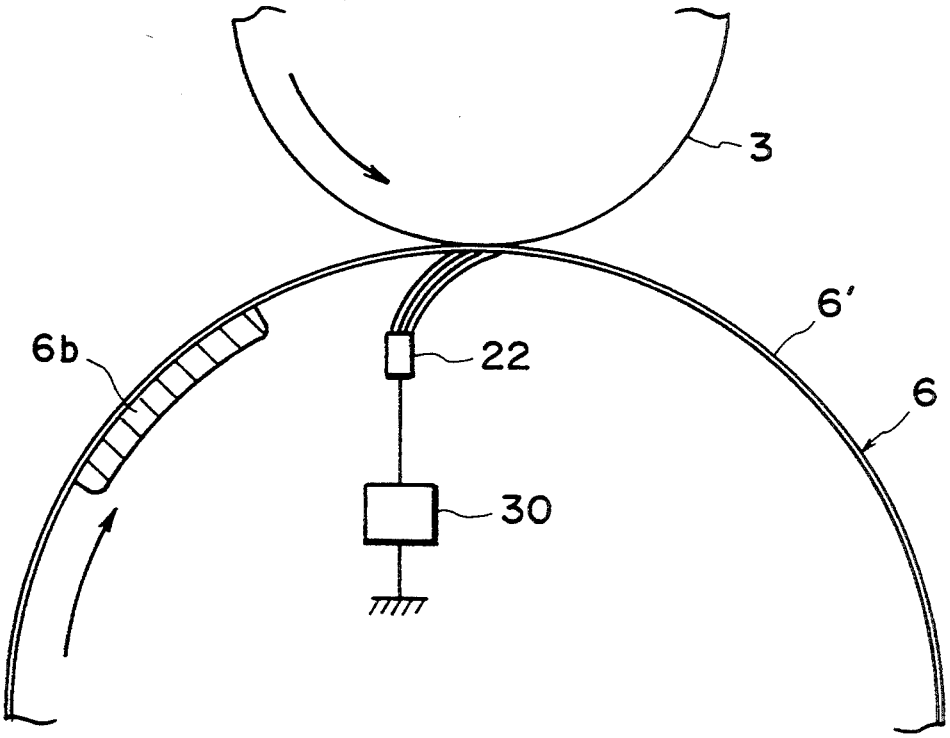
FIG. 2 is a sectional view of the transfer charger and transfer drum in the second preferred embodiment of an image forming apparatus in accordance with the present invention.

FIG. 2 is a schematic sectional view of a transfer drum comprising an alternative form of the transferring member in the second embodiment of the'image forming apparatus in accordance with the present invention.

This embodiment is characterized in that a conductive brush 22 is provided as the transferring member. The conductive brush 22 contacts the dielectric sheet 6', on the back surface, in the transfer station where the photosensitive drum 3 contacts the transfer drum 6. The conductive brush 22 is connected to the bias power source to be imparted with a voltage.

The conductive brush 22 is made of micro-fiber which is elastic and electrically conductive. In this embodiment, micro-acrylic-fiber made conductive by being dyed with copper sulfate is used as the conductive fiber for the conductive brush 22. Other fibers are also acceptable as the conductive fiber, for example: stainless steel fiber having a diameter of 8 to 15 μm; metal plated resin fiber produced by plating resin fiber, such as acrylic, nylon, polyester, or rayon, with metal; or composite fiber produced by mixing micro particle material such as carbon, or metal powder, in resin; or carbon fiber produced by carbonizing the resin fiber or the like to impart conductivity. As for the volumetric resistivity of the conductive fiber, the conductive fiber having a volumetric resistivity value of no more than $10^{10}$ ohm.cm is acceptable, preferably, no more than $10^8$ ohm.cm.

The conductive brush 22 extends upward, and before it touches the back side of the dielectric sheet 6', on the entrance side of the transfer station, its tip leans toward the downstream side to which the dielectric sheet 6' moves, touching thereby the dielectric sheet 6', across a range between where the transfer material carried on the dielectric sheet 6' initiates its contact with the photosensitive drum 3 and where it separates itself from the photosensitive drum 3. Since the conductive brush 22 has elasticity and is disposed extremely close to the dielectric sheet 6', it gently presses itself upon the back surface of the dielectric sheet 6'.

The way the conductive brush 22 contacts the dielectric sheet 6' is different from the way the conductive members having the different shapes such as sheet (elastic), blade, or roller, do. The latter form a substantially straight contact surface, but the contact by the conductive brush 22 is realized as each of the conductive micro-fibers individually makes contact with the dielectric sheet 6'. In other words, each fiber can conform to the contact pressure variance in the longitudinal direction of the contact surface, the coarseness or surface irregularity of the dielectric sheet 6', the steps formed by the connecting member **6*b*, or the like. Therefore, the conductive brush 22** makes more flexible and uniform contact without being affected by such factors as described above.

Thus, the conductive brush 22 can make better contact with the dielectric sheet 6' than the conductive roller 21, that is, the embodiment shown in FIG. 1, whereby the transfer spot caused by abnormal discharge can be surely prevented, offering wider transfer latitude (in particular, during a low humidity period).

This embodiment was also subjected to a test in which four toner images of different color were transferred onto both surfaces of a transfer material while 20 μA was flowed using the conductive brush 22, under an ambient temperature condition of 20° C. and humidity of 60%. The result was an excellent full-color image on both surfaces, with no transfer error.

Figure 3:
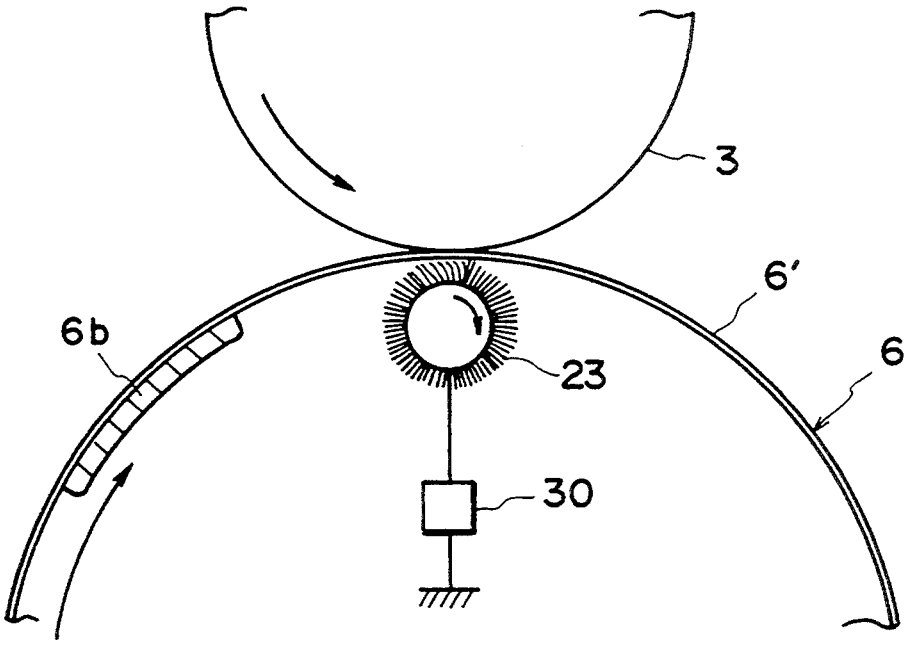
FIG. 3 is a sectional view of the transfer charger and transfer drum in the third embodiment of an image forming apparatus in accordance with the present invention.

FIG. 3 is a schematic sectional view of a further alternative of the transferring member disposed in the transfer drum of the third embodiment of the image forming apparatus in accordance with the present invention. This embodiment is characterized in that a conductive fur brush 23 is employed as the transferring member. The conductive fur brush 23 is in contact with the back surface of the dielectric sheet 6', in the same manner as the preceding embodiments, at a location corresponding to where the photosensitive drum 3 is in contact with the transfer drum 6 in the transfer station, and is connected to a bias power source 30 which supplies a voltage to the transfer fur brush 23.

In this embodiment, the conductive fur brush 23 is a cylindrical brush, in which conductive fiber fabric with raised fibers is glued around a round metallic rod with a conductive adhesive, and the raised fibers are trimmed to a height of 5 mm, causing the overall diameter to be 18 mm.

As for the conductive fiber fabric of the conductive fur brush 23, acrylic fiber is dyed with copper sulfate to make it conductive. However, also in this embodiment, other fibers are acceptable as the conductive fiber, for example: stainless steel fiber having a diameter of 8 to 15 μm; metal plated resin fiber produced by plating resin fiber, such as acrylic, nylon, polyester, or rayon, with metal; or composite fiber produced by mixing micro particle material such as carbon, or metal powder, in resin; or carbon fiber produced by carbonizing the resin fiber or the like to impart conductivity. As for the volumetric resistivity of the conductive fiber, the conductive fiber having a volumetric resistivity value of no more than $10^{10}$ ohm.cm is acceptable, preferably, no more than $10^8$ ohm.cm, as it was in the preceding embodiment.

The conductive fur brush 23 touches the dielectric sheet 6' across a range between where the transfer material carried on the dielectric sheet 6' initiates its contact with the photosensitive drum 3 and where it separates itself from the photosensitive drum 3. Since the conductive fur brush 23 has elasticity and is disposed extremely close to the dielectric sheet 6', it gently presses itself upon the back surface of the dielectric sheet 6'. This conductive fur brush 23 may be slaved to the rotation of the transfer drum 6, so that it moves at the same speed as the dielectric sheet 6', or may be directly driven at a different peripheral speed.

This embodiment was also subjected to a test in which four toner images of different color were transferred onto both surfaces of a transfer material, using the conductive fur brush 23 as the transferring member, under the same condition as the preceding embodiment.

The result was an excellent full-colors image on both surfaces, with no transfer error.

The application of the present invention is not necessarily limited to the aforementioned color image forming apparatus employing only a single photosensitive drum. The effects of the present invention become more evident when it is applied to a high speed color image forming apparatus.

Hereinafter, the present invention is described referring to a case in which the present invention is applied to a typical high speed color copying machine employing two or more photosensitive drums, one photosensitive drum for each of the color toners.

Figure 7:
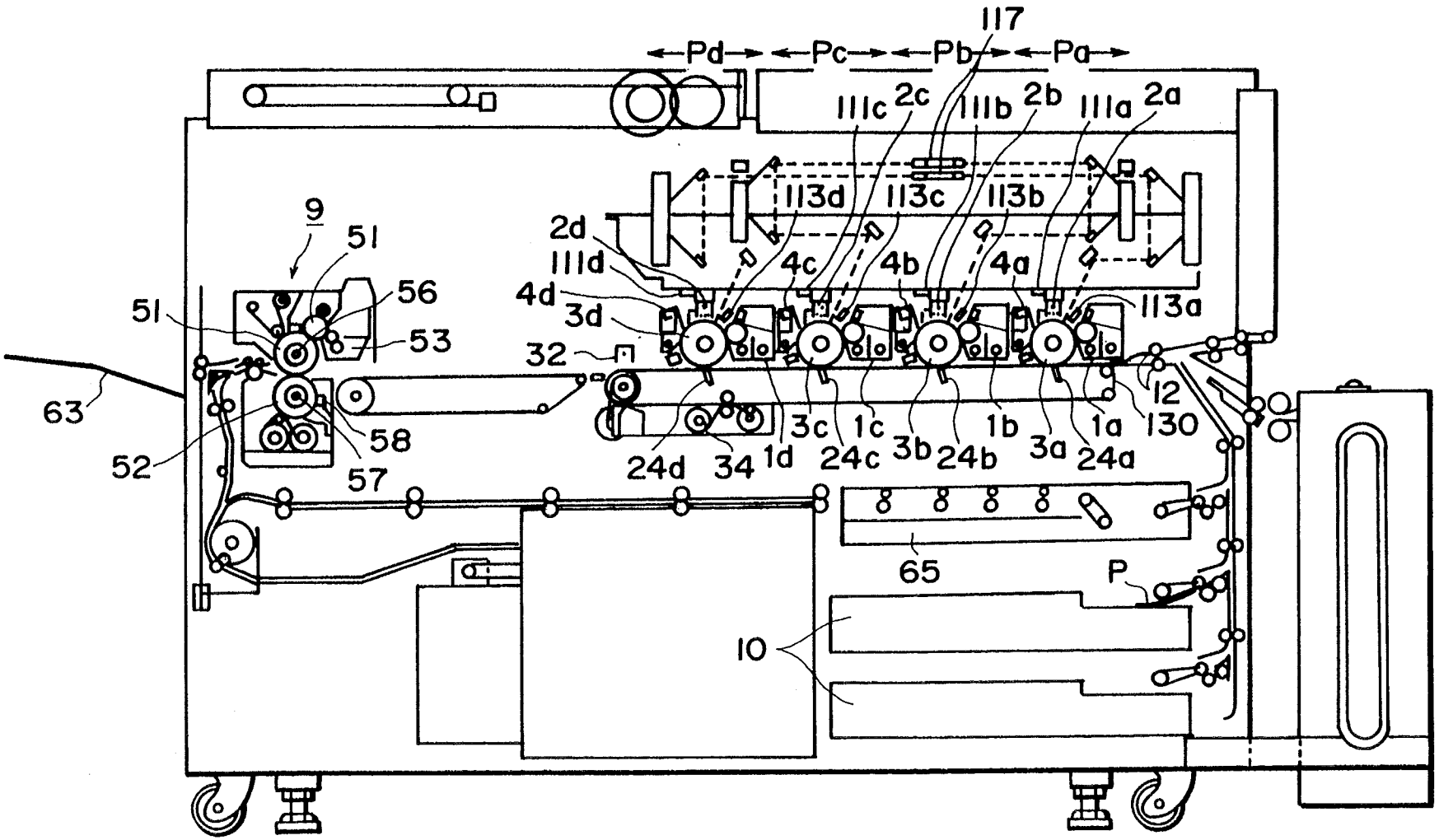
FIG. 7 is a schematic sectional view of an alternative embodiment of the image forming apparatus in accordance with the present invention, showing the essential structure.

Referring to FIG. 7, an example of such an electrophotographic color recording apparatus is briefly described.

In the main assembly of the electrophotographic color recording apparatus, first, second, third, and fourth image forming members Pa, Pb, Pc, Pd are disposed side by side, whereby latent images of different color are independently formed by the corresponding image forming members, through the developing and transferring processes.

As for the structure of the main assembly, the image forming members Pa, Pb, Pc, and Pd comprise their own image bearing member, that is, electrophotographically sensitive drums 3*a*, 3*b*, 3*c*, and 3*d*, respectively, in this embodiment. The toner images formed on the electrophotographically sensitive drums 3*a*, 3*b*, 3*c*, and 3*d* in the respective image forming members Pa, Pb, Pc, and Pd are transferred onto a recording material P moving adjacent to each of the image forming members while being carried on a recording material carrying member 130. Then, the transfer material P bearing now the toner images is conveyed further down the passageway to a fixing station 9, where the toner images are heated and pressed, in other words, fixed to the transfer material, which is discharged bearing this time a fixed color image composed of the toner images of different color.

Next, the image forming member on which the latent image is formed is described. The photosensitive drums 3*a*, 3*b*, 3*c*, and 3*d* are surrounded by: exposure lamps 111*a*, 111*b*, 111*c*, and 111*d*; drum chargers 2*a*, 2*b*, 2*c*, and 2*d*; a polygon mirror 117 for reflecting, in a scanning manner, a beam emitted from an unshown light source or beams emitted from unshown light sources; potential sensors 113*a*, 113*b*, 113*c*, and 113*d*, respectively; which are disposed adjacent to the respective peripheral surfaces of the photosensitive drums. A laser beam emitted from the unshown light source is reflected in the scanning manner by rotating the polygon mirror 117. This reflected scanning beam is reflected by a reflecting mirror changing its direction, and focused by an f-$\theta$ lens on the respective generating of the photosensitive drums 3*a*, 3*b*, 3*c*, and 3*d*, forming latent images corresponding to imaging signals.

Next, the developing member is described. The developers 1*a*, 1*b*, 1*c*, and 1*d* are filled by unshown supplying apparatuses, with cyan, (hereinafter, referred to as C), magenta (M), yellow (Y), and black (K) toners, by a predetermined amount. The latent images formed by the aforementioned scanning beam are developed by the developing agents contained in the developers 1*a*, 1*b*, 1*c*, and 1*d*, visualized thereby on the photosensitive drums 3*a*, 3*b*, 3*c*, and 3*d*.

Next, the transferring member is described. The recording material P is fed out of a recording material cassette 10, and after being properly timed by a registration roller 12, is conveyed by a recording material conveying member 130 to the transferring members.

Here, the recording material carrying member 130 is an endless belt of dielectric resin film such as polyethylene telephthalate resin (PET sheet) film, polyfluorovinylidene resin film, polyurethane resin film, or the like. It may be made endless by adhering ends of a strip of the film together or may be produced as a seamless endless belt. From the standpoint of cost, the endless type of belt is less suitable for mass production, considering the difficulty in imparting uniform physical properties across the entire length of the belt, instability in the belt length, manufacturing time, or the like. On the other hand, in the case of the belt with the seam, the seam portion of the belt is different from the rest of the belt in the physical properties such as surface irregularities, resistance value, or the like, and the effects of these differences are unavoidable when the toner images are transferred onto the recording material, at the spot right on the seam, in other words, the toner images become disturbed when they are transferred onto the recording material, at the spot right on the seam. Therefore, generally speaking, in order to achieve high image quality, an unshown means for detecting the seam location is provided for preventing the toner images from being transferred onto the recording material, at the spot right on the seam. As for the means for detecting this seam, if the recording material carrying member 130 is opaque, a marking with a reflective property different from that of the recording material carrying member 130 is placed at the seam, and this marking is detected by a reflection type optical sensor. If the recording material carrying member is transparent, the shape of the belt at the seam may be slightly changed (for example, making a small cutout) to be detected by a transmission type optical sensor. Further, a projection or the like may be provided at the seam to be detected by a mechanical sensor such as a displacement sensor or the like. Therefore, the belt length is preferred to be an integer multiple of the combined length of the recording materials and the interval between the recording materials.

After it is confirmed that the seam of the recording material conveying member is at a predetermined location, the recording material P is released by the registration roller 12 onto the recording material carrying member 130. At this time, an imaging start signal is sent out with a predetermined timing to form a latent image on the first photosensitive drum 3*a*. The latent image is visualized on the photosensitive member, and is transferred onto the recording material P as the recording material P is imparted with an electrical field or charge while it passes underneath the photosensitive drum 3*a*. Then, the recording material P is passed through the rest of the image forming members, that is, the second to fourth members Pb to Pd, to receive the toners images, while being firmly held on the recording material carrying member 130 by the electrostatic force. After the fourth toner image is transferred onto the recording material P in the same manner as the preceding images, the recording material is cleared of the charge by a separator charger 32, and separates itself from the recording material carrying member 130 as the electrostatic force attenuates, to be conveyed to a fixing member 9.

Next, the fixing member will be described.

The fixing member 9 comprises: a fixing roller 51, a pressure roller 52, heat resistant cleaning members 54 and 55 for cleaning the preceding two rollers, heaters 56 and 57 for heating the preceding two rollers, an oil coating roller 51 for coating the fixing roller with parting oil such as dimethyl silicone, an oil reservoir 53, and a thermistor 58 to be used for controlling the fixing temperature.

Next, the cleaning member is described. After the completion of the toner image transfer, the developing agent remaining still on the photosensitive drums is removed by the photosensitive member cleaning members 4*a*, 4*b*, 4*c*, and 4*d* to prepare the photosensitive drums for the next latent image forming operation carried out immediately. On the other hand, the residual developing agent on the recording material carrying member 130 is removed by a nonwoven fabric 34. In this case, a blade or fur brush may be used as the developing agent removing means to scrape away the agent. It is also acceptable to use a combination of them.

When the image is formed on both surfaces of the recording material P, the recording material P is not discharged into a discharge tray 63 after it goes through the image forming cycle for the first surface and comes out of the fixing member 9. Instead, it is turned over by a flapper or the like, and is sent to an intermediate tray 65 where it is temporarily stored. For example, when the images are consecutively recorded on both surfaces of 10 recording materials P, each recording material P is temporarily stored in the intermediate tray 65 after its first surface is fixed. Next, in order for the image to be transferred onto the second surface, the recording material P is conveyed through the registration roller 12 and the transfer station of each transferring member, and delivered to the fixing member 9 to fix the toner images on the second surface.

In order to accomplish a high speed using this type of color image forming apparatus, the transfer materials must be consecutively conveyed at a high speed, which creates such a situation in which the transfer current cannot be turned on or off fast enough to accommodate the speed of the recording material conveyance, that is, the start-up speed of the high voltage cannot keep up with the speed of the recording material, necessitating thereby a more efficient high voltage control system, which in turn increases the overall cost of the apparatus.

This problem can be solved, in other words, the toner image can be reliably and inexpensively transferred, by keeping constant the transfer current output while two or more transfer materials are consecutively sent in for toner image transfer.

When two or more single sided originals having different images are consecutively copied in such a manner that the first original is copied onto the first surface of the first recording material; the second original onto the second surface of the first recording material; the third original onto the first surface of the second recording material; the fourth original onto the second surface of the recording material; and so on, the first recording material, on the first surface of which the toner image of the first original is transferred is sent to the intermediate tray 65, from which it is again sent out onto the recording material carrying member 130 so that the toner image of the second original is transferred onto its second surface. At approximately the same time, the second recording material is released from the sheet feeding cassette 10 onto the recording material carrying member 130 so that the toner image of the third original is transferred onto its first surface. In this manner, the first recording material being carried to receive the toner image on its second surface and the second recording material being carried to receive the toner image on the first surface are consecutively carried, at the same time, on the recording material carrying member 130, with a proper interval between the trailing end of the first recording material and the leading end of the second recording material.

According to the present invention, the power source supplies the same amount of transfer current to the transfer charger 24*a*, 24*b*, 24*c*, and 24*d*, whether for transferring the toner image onto the first surface or the second, and therefore, the amount of transfer current to be supplied to the transfer charger 24*a*, 24*b*, 24*c*, and 24*d* for transferring the images onto the first recording material, on the second surface of which the image is transferred, is the same as that for transferring the image onto the second recording material, on the first surface of which the image is transferred. In other words, it is unnecessary to switch the amount of transfer current, enabling the interval between the trailing end of the first recording material and the leading end of the second recording material to be reduced. Therefore, the overall image forming speed can be increased when two or more recording materials are consecutively fed to form the images on both surfaces, in other words, image forming productivity is improved.

Further, this embodiment, in other words, means for keeping the transfer current constant so that a recording material, on the first surface of which the toner image is transferred, and a recording material, on the second surface of which the toner image is transferred, are carried at the same time on the recording material carrying member, is applicable also to the image forming apparatus as shown in FIG. 4 in which two or more recording materials can be carried at the same time and the images are automatically transferred on both surfaces of the recording material, and the same effects can be obtained. In this case, even better results can be obtained if it is possible to use the same transfer control conditions for each of the toner images of different color.

Further, in the apparatuses shown in FIGS. 4 and 7, the toner image is transferred onto the second surface of a recording material after the toner image is transferred onto the first surface, and therefore, a conveyance passage is provided for automatically conveying the transfer material to the transfer station. However, this transfer material conveyance passage may be omitted, and instead, it may be so arranged that after the image is transferred onto the first surface of the transfer material and the transfer material is discharged into the discharge tray, the transfer material is picked up by an operator, and placed in the sheet feeding cassette, with the second surface facing upward, so that the toner image is transferred onto the second surface this time.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing a toner image;

a transfer material carrying member for carrying a transfer material, the transfer material carrying member being a dielectric sheet;

a transferring member for transferring the toner image from said image bearing member onto the transfer material carried on said transfer material carrying member, said transferring member being contactable to a back side of said transfer material carrying member;

current control means for keeping constant current supplied to said transferring member;

wherein after the toner image is transferred onto a first surface of the transfer material, a toner image can be transferred onto the second surface of the same transfer material; and wherein when the toner image is transferred onto the second surface, said current control means supplies said transferring member with a predetermined current.

2. An image forming apparatus according to claim 1, wherein said current control means supplies said transferring member with a same predetermined current when the toner image is transferred onto the first surface.

3. An image forming apparatus according to claim 1, wherein the current supplied to said transferring member for transferring the toner image onto the first surface of the transfer material is the same as that for transferring the toner image onto the second surface.

4. An image forming apparatus according to claim 1, wherein a first color image and second color image can be transferred onto the transfer material, and a predetermined current supplied to the transferring member when the toner image of the first color is transferred onto the second surface of the transfer material is the same as that when the second color toner image is transferred onto the second surface.

5. An image forming apparatus according to claim 4, wherein a predetermined current supplied by said current controlling means to said transferring member when the toner image of the first color is transferred onto the first surface of the transfer material is the same as that when the second color toner image is transferred onto the first surface of the transfer material.

6. An image forming apparatus according to claim 1, wherein said apparatus is capable of forming a full-color toner image, and the predetermined current supplied by said current controlling means to said transferring member for transferring each of the toner images of different color to the first surface of the transfer material is the same as that when it is transferred onto the second surface.

7. An image forming apparatus according to claim 1, further comprising a fixing means for fixing the toner image to the transfer material, and a toner image is transferred onto the second surface of the transfer material after the toner image transferred onto the first surface is fixed by said fixing means.

8. An image forming apparatus according to claim 7, wherein said fixing means comprises a fixing member having a nip through which the transfer material is fed with a predetermined contact pressure applied thereto, and means for coating said fixing member with parting oil.

9. An image forming apparatus according to claim 7, further comprising conveying means for conveying the transfer material bearing the fixed image on its first surface to said transfer material carrying member so that the toner image is transferred onto its second surface.

10. An image forming apparatus according to claim 1, wherein said transfer material carrying member is capable of carrying the first transfer material, on the second surface of which the toner image is to be transferred, and the second transfer material, on the first surface of which the toner image is to be transferred, at the same time, at different locations on its carrying surface.

11. An image forming apparatus according to claim 10, wherein the predetermined current supplied by said current controlling means to said transferring member is the same when the toner image is transferred onto the first transfer material and when it is onto the second transfer material.

12. Am image forming apparatus according to claim 11, wherein a toner image of two or more colors can be formed on said image bearing member, and the predetermined currents supplied by said current controlling means to said transferring means are the same when the toner images of different colors are transferred onto the first surface of the transfer material in a superimposing manner, and when it is transferred onto the second surface in the same manner.

13. An image forming apparatus according to claim 1, wherein the volumetric resistivity value of said transferring member is no more than $10^8$ ohm.cm.

14. An image forming apparatus according to claim 1, wherein said transferring member is in a form of a brush.

15. An image forming apparatus according to claim 1, wherein said transferring member is in a form of sheet.

16. An image forming apparatus comprising:

an image bearing member for bearing a toner image;

a transfer material carrying member for carrying and conveying a transfer material to a transferring station at which the toner image is transferred from said image bearing member onto the transfer material carried on said transfer material carrying member;

wherein after the toner image is transferred onto a first surface of the transfer material, a toner image can be transferred onto the second surface, of the transfer material, and said transfer material carrying member can carry a first transfer material, on the second surface of which the toner image is to be transferred, and a second transfer material, on the first surface of which the toner image is to be transferred, at the same time, at different locations on its carrying surface.

17. An image forming apparatus according to claim 16, further comprising a transferring member for imparting an electrical charge to said transfer material carrying member so that the toner image is transferred onto the transfer material carried on said transfer material carrying member.

18. An image forming apparatus according to claim 17, further comprising current controlling means for supplying said transferring member with a predetermined current, and the current supplied by said current controlling means to said transferring means is the same when the toner image is transferred onto the first transfer material and when it is onto the second transfer material.

19. An image forming apparatus according to claim 18, wherein a toner image of two or more colors can be formed on said image bearing member, and the predetermined currents supplied by said current controlling means to said transferring means are the same when the toner images of different colors are transferred onto the first surface of the transfer material in a superimposing manner, and when it is transferred onto the second surface in the same manner.

20. An image forming apparatus according to claim 18 or 19, wherein said transferring member is contactable to the back side said transfer material carrying member.

21. An image forming apparatus according to claim 16, further comprising a fixing means for fixing the toner image to the transfer material, and a toner image is transferred onto the second surface of the transfer material after the toner image transferred onto the first surface is fixed by said fixing means.

22. An image forming apparatus according to claim 21, wherein said fixing means comprises a fixing member having a nip through which the transfer material is fed with a predetermined contact pressure applied thereto, and means for coating said fixing member with parting oil.

23. An image forming apparatus according to claim 21, further comprising conveying means for conveying the transfer material bearing the fixed image on its first surface to said transfer material carrying member so that the toner image is transferred onto its second surface.

24. An image forming apparatus according to claim 20, wherein the volumetric resistivity value of said transferring member is no more than $10^8$ ohm.cm.

25. An image forming apparatus according to claim 20, wherein said transferring member is in a form of a brush.

26. An image forming apparatus according to claim 20, wherein said transferring member is in a form of sheet.

27. An image forming apparatus according to claim 16, wherein two or more toner images of different colors are transferred onto the first and the second transfer materials carried on said transfer material carrying member in a superimposing manner.

28. An image forming apparatus according to claim 27, wherein said apparatus is capable of forming full-color toner images on the first and second transfer materials.

29. An image forming method comprising:

preparing an image bearing member for bearing a toner image;

preparing a transfer material carrying member for carrying a transfer material, the transfer material carrying member being a dielectric sheet;

preparing a transferring member for transferring the toner image from said image bearing member onto the transfer material carried on said transfer material carrying member, said transferring member being contactable to a back side of said transfer material carrying member;

preparing current control means for keeping constant current supplied to said transferring member;

forming an image on a first surface of the transfer material, reversing the transfer material;

forming an image on a second surface of the transfer material:

wherein when the toner image is transferred onto the second surface, the transferring member is supplied with a predetermined current by said constant current control means.

* * * * *

UNITED STATES PATENT AND TRADEMARK OFFICE

CERTIFICATE OF CORRECTION

PATENT NO. : 5,414,501

DATED : May 9, 1995

INVENTOR(S) : YASUSHI MIURA, ET AL.

It is certified that error appears in the above-indentified patent and that said Letters Patent is hereby corrected as shown below:

Column 1,
line 44, "a" should read --an--.

Column 2,
line 12, "surface" should read --surfaces--.

Column 3,
line 64, "images" should read --image--.

Column 5,
line 13, "$10^8$ ohm.ch," should read --$10^8$ ohm.cm,--; and
line 15, "ohm.ch," should read --ohm.cm,--.

Column 7,
line 19, "the'image" should read --the image--.

Column 9,
line 1, "full-colors" should read --full-color--.

Column 11,
line 8, "remaining still" should read --still remaining--.

UNITED STATES PATENT AND TRADEMARK OFFICE

CERTIFICATE OF CORRECTION

PATENT NO. : 5,414,501

DATED : May 9, 1995

INVENTOR(S) : YASUSHI MIURA, ET AL.

It is certified that error appears in the above-indentified patent and that said Letters Patent is hereby corrected as shown below:

Column 14, line 12, "onto" should read --transferred onto--;

line 14, "Am" should read --An--; and line 61, "onto" should read --transferred onto--.

Column 15, line 6, "side" should read --side of--.

Signed and Sealed this

Twelfth Day of September, 1995

Bruce Lehman

*Attest:*

BRUCE LEHMAN

*Attesting Officer*

*Commissioner of Patents and Trademarks*